US008326168B2

(12) United States Patent
Miyata et al.

(10) Patent No.: US 8,326,168 B2
(45) Date of Patent: Dec. 4, 2012

(54) HEATING DEVICE AND IMAGE FORMING APPARATUS

(75) Inventors: Toshiyuki Miyata, Ebina (JP); Junpei Amano, Ebina (JP); Haruhiko Nishida, Ebina (JP); Tohru Hasegawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 207 days.

(21) Appl. No.: 12/852,827

(22) Filed: Aug. 9, 2010

(65) Prior Publication Data

US 2011/0142480 A1 Jun. 16, 2011

(30) Foreign Application Priority Data

Dec. 10, 2009 (JP) ..... 2009-280645

(51) Int. Cl.
*G03G 15/20* (2006.01)

(52) U.S. Cl. ..... 399/69; 399/92; 399/329

(58) Field of Classification Search ..... 399/69, 399/328, 329, 92; 219/216
See application file for complete search history.

(56) References Cited

U.S. PATENT DOCUMENTS

| | | | | |
|---|---|---|---|---|
| 3,867,026 | A * | 2/1975 | Ogawa | 399/398 |
| 8,081,903 | B2 * | 12/2011 | Hasegawa | 219/216 X |
| 2007/0183808 | A1 * | 8/2007 | Jeon | 399/92 |
| 2009/0116885 | A1 * | 5/2009 | Ando | 399/329 |
| 2009/0226200 | A1 * | 9/2009 | Ando | 399/69 |

FOREIGN PATENT DOCUMENTS

| | | | |
|---|---|---|---|
| JP | A-2003-5566 | | 1/2003 |
| JP | 2007-233228 | A * | 9/2007 |

* cited by examiner

*Primary Examiner* — Sophia S Chen
(74) *Attorney, Agent, or Firm* — Oliff & Berridge, PLC

(57) ABSTRACT

A heating device includes: a heating member heating a recording medium; a pressure member forming a heating pressure portion between the pressure member and the heating member by coming into pressure contact with the heating member, the heating pressure portion passing through the recording medium; a tensioning member placed to face the pressure member across the heating member to provide a tension to the heating member; and a cooling unit cooling the pressure member, the cooling unit including: an air blower generating an air flow; a circulator circulating the air flow along the pressure member; and a group of protruding portions provided on the circulator to guide the air flow.

22 Claims, 4 Drawing Sheets

HEATING DEVICE AND IMAGE FORMING APPARATUS

CROSS REFERENCE TO RELATED APPLICATIONS

This application is based on and claims priority under 35 USC §119 from Japanese Patent Application No. 2009-280645 filed Dec. 10, 2009.

BACKGROUND

1. Technical Field

The present invention relates to a heating device and an image forming apparatus.

2. Related Art

There has been known, as a fixing device used for an image forming apparatus such as a copying machine and a printer, a device including a heating member configured with a belt member (a fixing belt) that is provided with a tension by plural rolls.

SUMMARY

According to an aspect of the present invention, there is provided a heating device including: a heating member that heats a recording medium; a pressure member that forms a heating pressure portion between the pressure member and the heating member by coming into pressure contact with an outer circumferential surface of the heating member, the heating pressure portion being passed through by the recording medium; a tensioning member that is placed to face the pressure member with the heating member interposed therebetween, and that provides a tension to the heating member; and a cooling unit that cools the pressure member, the cooling unit including: an air blower that generates an air flow; a circulator that circulates the air flow along the pressure member; and a group of protruding portions that is provided on the circulator to guide the air flow.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the attached drawings.

<Description of Image Forming Apparatus>

Figure 1:
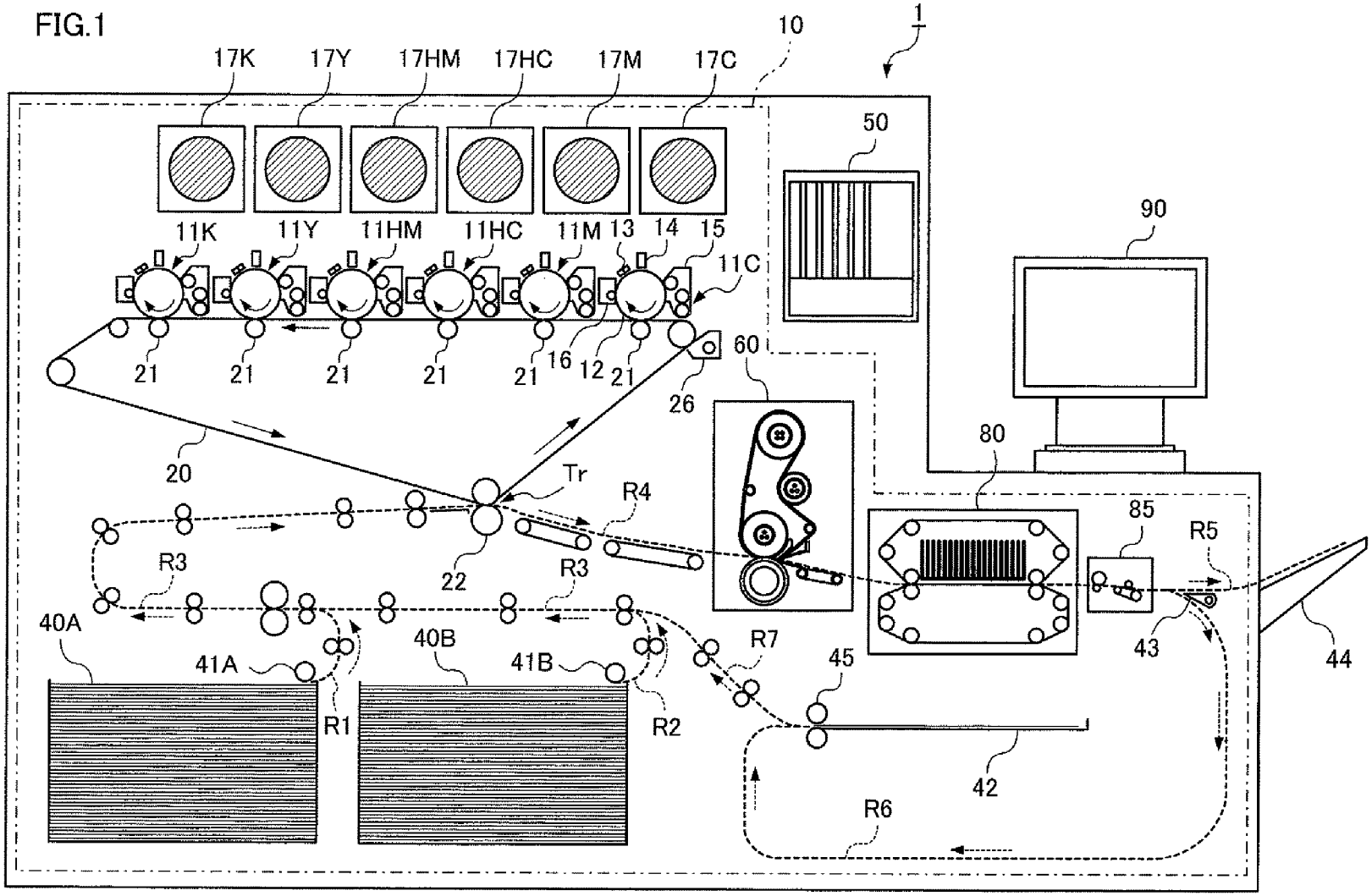
FIG. 1 illustrates a configuration example of an image forming apparatus employing a fixing unit according to an exemplary embodiment.

FIG. 1 illustrates a configuration example of an image forming apparatus 1 employing a fixing unit (heating unit) 60 according to the exemplary embodiment. The image forming apparatus 1 shown in FIG. 1 is a so-called "tandem-type" color printer, and includes: an image forming portion 10 that forms an image based on image data; a main controller 50 that performs overall control of operations of the image forming apparatus 1, communication with, for example, a personal computer (PC) or the like, image processing for image data, and the like; and a user interface (UI) portion 90 that receives an operation input from a user and displays various kinds of information to the user.

<Description of Image Forming Portion>

The image forming portion 10 is a functional portion for forming an image using for example, an electrophotographic system, and includes six image forming units 11C, 11M, 11HC, 11HM, 11Y, 11K (hereinafter, referred to as "image forming units 11") arranged in parallel, provided as an example of an image forming unit. As functional members, each image forming unit 11 includes, for example, a photoconductive drum 12, a charging device 13, an exposure device 14, a developing device 15, and a cleaner 16. On the photoconductive drum 12, an electrostatic latent image is formed, and then a toner image of a certain color is formed. The charging device 13 charges the surface of the photoconductive drum 12 at a predetermined potential. Based on image data, the exposure device 14 exposes the photoconductive drum 12 charged by the charging device 13. The developing device 15 develops the electrostatic latent image formed on the photoconductive drum 12 by toner of the certain color. The cleaner 16 cleans the surface of the photoconductive drum 12 after transfer.

The developing device 15 of each image forming unit 11 is connected, through a toner supply path (not shown), to a corresponding one of toner containers 17C, 17M, 17HC, 17HM, 17Y, 17K (hereinafter, referred to as "toner containers 17") storing toner of respective colors. The toner containers 17 replenish the developing devices 15 with toner of respective colors using replenishment screws (not shown) provided in the toner supply paths.

The image forming units 11 have almost the same configuration except for the color of toner contained in the developing devices 15. The image forming units 11 form toner images of cyan (C), magenta (M), highly saturated cyan (HC), highly saturated magenta (HM), yellow (Y), and black (K), respectively. Here, HC is cyan having a cyan hue and having a brighter color tone and a higher saturation than C. HM is magenta having a magenta hue and having a brighter color tone and a higher saturation than M.

In addition, the image forming portion 10 includes: an intermediate transfer belt 20 on which the toner images of the respective colors formed on the photoconductive drums 12 of the image forming units 11 are transferred; and primary transfer rolls 21 that transfer the toner images of the respective colors formed on the photoconductive drums 12 of the image forming units 11 onto the intermediate transfer belt 20 (primary transfer). The image forming portion 10 further includes: secondary transfer roll 22 that collectively transfers the toner images of the respective colors that have been transferred onto the intermediate transfer belt 20 in an superimposed manner onto a sheet being a recording medium (secondary transfer); and the fixing unit 60, as an example of a heating device, that fixes the toner images of the respective colors after the secondary transfer onto the sheet.

In addition, the image forming portion 10 includes: a cooling unit 80 that cools the toner images of the respective colors fixed onto the sheet by the fixing unit 60 so that toner images of the respective colors are more securely fixed onto the sheet; and a curl correction unit 85 that corrects a curl in the sheet.

Note that in the image forming apparatus 1 of the exemplary embodiment, a transfer unit is formed of the intermediate transfer belt 20, the primary transfer rolls 21, and the secondary transfer roll 22. Further, an area where the secondary transfer roll 22 is placed and where the toner images of the respective colors on the intermediate transfer belt 20 are transferred onto the sheet through the secondary transfer is hereinafter referred to as "secondary transfer area Tr."

<Description of Sheet Transport System>

As a sheet transport system, the image forming portion 10 includes: multiple (two in the exemplary embodiment) sheet containers 40A and 40B that hold sheets; pick-up rolls 41A and 41B that pick up a sheet held in the sheet containers 40A and 40B, respectively, and transport the sheet; a first transport path R1 for transporting the sheet from the sheet container 40A; and a second transport path R2 for transporting the sheet from the sheet container 40B. The image forming portion 10 further includes a third transport path R3 for transporting the sheet from the sheet container 40A or 40B toward the secondary transfer area Tr. Moreover, the image forming portion 10 includes: a fourth transport path R4 for transporting the sheet onto which the toner images of the respective colors are transferred at the secondary transfer area Tr, so that the sheet passes the fixing unit 60, the cooling unit 80, and the curl correction unit 85; and a fifth transport path R5 for transporting the sheet from the curl correction unit 85 toward a sheet stacking portion 44 provided at an exit portion of the image forming apparatus 1.

Transport rolls and transfer belts are arranged along the first transport path R1 to the fifth transport path R5, sequentially transporting a sheet being fed.

<Description Of Duplex Transport System>

As a duplex transport system, the image forming portion 10 includes: an intermediate sheet container 42 that temporarily holds the sheet having a first surface onto which the toner images of the respective colors are fixed; a sixth transport path R6 for transporting the sheet from the curl correction unit 85 toward the intermediate sheet container 42; and a seventh transport path R7 for transporting the sheet held in the intermediate sheet container 42 toward the third transporting path R3 described above. The image forming portion 10 further includes: a switching mechanism 43 that is placed downstream of the curl correction unit 85 in a sheet transport direction, and that selectively switches the transport direction of the sheet between the fifth transport path R5 for transporting the sheet toward the sheet stacking portion 44 and the sixth transport path R6 for transporting the sheet toward the intermediate sheet container 42; and pick-up rolls 45 that pick up the sheet held in the intermediated container 42 and transport the sheet toward the seventh transport path R7.

<Description of Image Forming Operations>

Next, a description is given of basic image forming operations of the image forming apparatus 1 according to the exemplary embodiment.

The image forming units 11 of the image forming portion 10 form toner images of colors of C, M, HC, HM, Y, and K, respectively, by an electrophotographic process using the above-described functional members. The primary transfer rolls 21 sequentially transfer the toner images of the respective colors formed on the respective image forming units 11 onto the intermediate transfer belt 20 (primary transfer) to form a composite toner image in which the toner images of the respective colors are superimposed on one another. Along with the movement of the intermediate transfer belt 20 (arrow direction), the composite toner image on the intermediate transfer belt 20 is transported to the secondary transfer area Tr where the secondary transfer roll 22 is placed.

Meanwhile, in the sheet transport system, according to the timing at which the image forming units 11 start image formation, the pick-up roll 41A or 41B rotates and picks up a sheet from the sheet container 40A or 40B, whichever is designated by the UI portion 90, for example. The sheet picked up by the pick-up roll 41A or 41B is transported along the first transport path R1 or the second transport path R2 and then along the third transport path R3, and reaches the secondary transfer area Tr.

In the secondary transfer area Tr, the composite toner image held on the intermediate transfer belt 20 is collectively transferred to the sheet by a transfer electric field formed by the secondary transfer roll 22 (secondary transfer).

Thereafter, the sheet to which the composite toner image is transferred is separated from the intermediate transfer belt 20 and is transported to the fixing unit 60 along the fourth transport path R4. The composite toner image on the sheet transported to the fixing unit 60 is subjected to a fixing process by the fixing unit 60 and is thus fixed onto the sheet. Then, the sheet having the fixed image formed thereon is cooled by the cooling unit 80, and a curl of the sheet is then corrected by the curl correction unit 85. After that, in a simplex printing mode, the sheet having passed the curl correction unit 85 is led by the switching mechanism 43 to the fifth transport path R5 and is transported toward the sheet stacking portion 44.

Note that the cleaners 16 remove toner attached to the photoconductive drums 12 after the primary transfer (residual toner after primary transfer), and a belt cleaner 26 removes toner attached to the intermediate transfer belt 20 after the secondary transfer (residual toner after secondary transfer).

In a duplex printing mode, on the other hand, the sheet having the first surface onto which the image is fixed by the above described process passes the curl correction unit 85 and then is led by the switching mechanism 43 to the sixth transport path R6 to be transported to the intermediate sheet container 42. Then, according to the timing at which the image forming units 11 start image formation on a second surface of the sheet, the pick-up rolls 45 rotate and pick up the sheet from the intermediate sheet container 42. The sheet picked up by the pick-up rolls 45 is transported along the seventh transport path R7 and the third transport path R3, and reaches the secondary transfer area Tr.

In the secondary transfer area Tr, as in the case of the first surface, the composite toner image for the second surface held on the intermediate transfer belt 20 is collectively transferred onto the sheet by a transfer electric field formed by the secondary transfer roll 22 (secondary transfer).

Then, as in the case of the first surface, the sheet having the toner image transferred on both surfaces undergoes fixing at the fixing unit 60, is cooled by the cooling unit 80, and a curl of the sheet is corrected by the curl correction unit 85. After that, the sheet having passed the curl correction unit 85 is led by the switching mechanism 43 to the fifth transport path R5 and is transported toward the sheet stacking portion 44.

In a manner described above, the cycle of the image formation process of the image forming apparatus 1 is repeated in cycles for the number of prints to be produced.

<Description of Fixing Unit Configuration>

Next, a description is given of the fixing unit 60 used in the image forming apparatus 1 of the exemplary embodiment.

Figure 2:
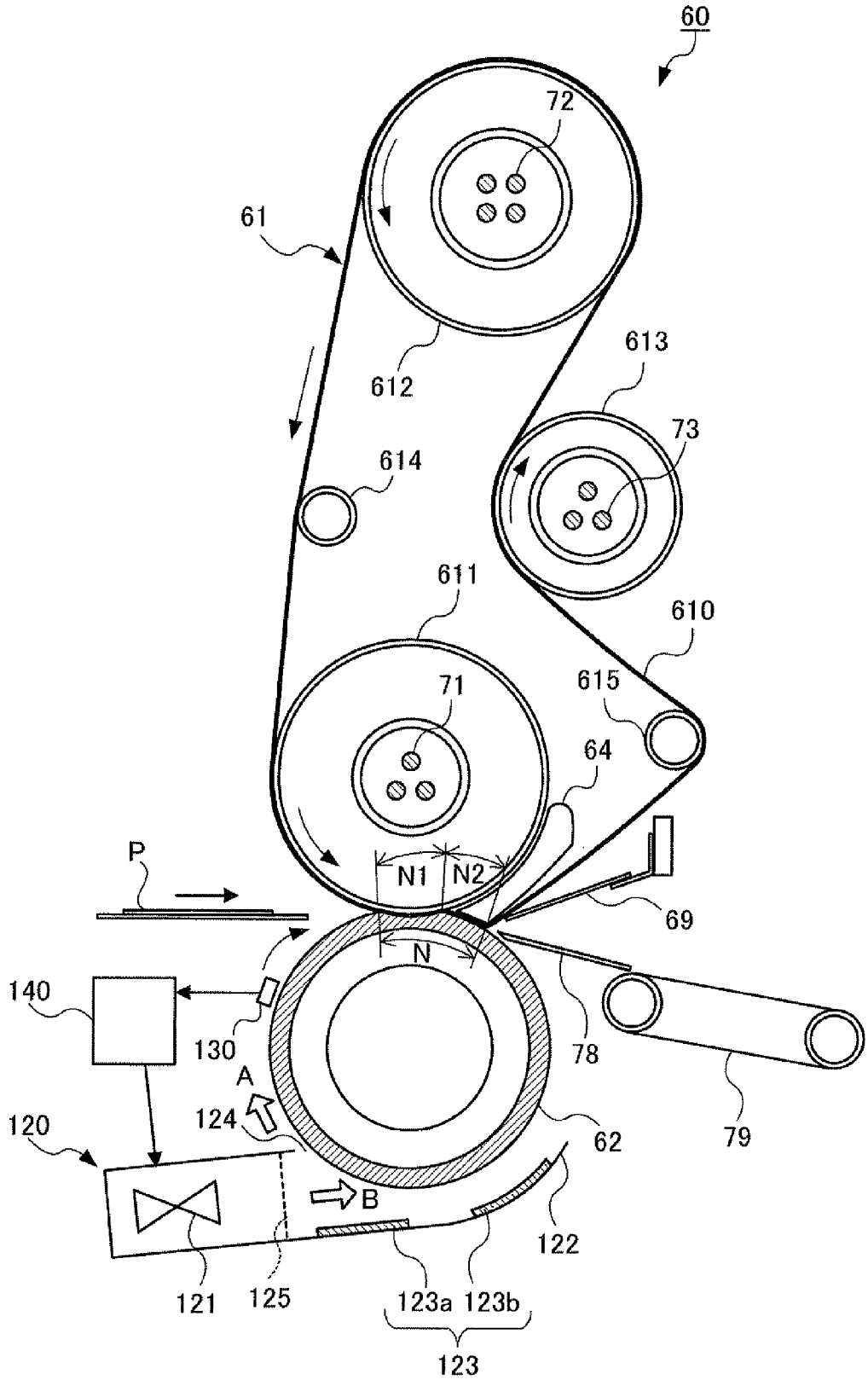
FIG. 2 is a cross-sectional view illustrating the configuration of the fixing unit of the exemplary embodiment.

FIG. 2 is a cross-sectional view illustrating the configuration of the fixing unit 60 of the exemplary embodiment. As main parts, the fixing unit 60 includes a fixing belt module 61 and a pressure roll 62. The pressure roll 62 is an example of a pressure member configured to be contactable with and separable from the fixing belt module 61.

The fixing belt module 61 includes a fixing belt 610, a fixing roll 611, an inside heating roll 612, and an outside heating roll 613. The fixing belt 610 is an example of a heating member that fixes a toner image on a sheet P. The fixing roll 611 is a tensioning member that is placed facing the pressure roll 62 with the fixing belt 610 interposed therebetween and that rotates while providing a tension to the fixing belt 610.

The fixing roll 611 heats the fixing belt 610 from inside at a nip portion (heating pressure portion) N which is an area where the fixing belt module 61 and the pressure roll 62 are in pressure contact with each other (in contact while pressing each other). The inside heating roll 612 is an example of an inside heating unit that heats the fixing belt 610 while providing a tension to the fixing belt 610 from inside. The outside heating roll 613 is an example of an outside heating portion that heats the fixing belt 610 while providing a tension to the fixing belt 610 from outside. The fixing belt module 61 also includes a tensioning roll 614, a peeling pad 64, and a tensioning roll 615. The tensioning roll 614 provides a tension to the fixing belt 610 between the fixing roll 611 and the inside heating roll 612 (upstream of nip portion N). The peeling pad 64 is an example of a peeling member placed downstream of the nip portion N and adjacent to the fixing roll 611. The tensioning roll 615 provides a tension to the fixing belt 610, downstream of the nip portion N.

The fixing belt 610 is formed of a base layer made of, for example, a polyimide resin, an elastic layer stacked on a surface side (outer circumferential side) of the base layer and made of a silicon rubber, and a release layer covering the elastic layer and made of a PFA (tetrafluoroethylene-perfluoro alkyl vinyl ether copolymer resin). Here, the elastic layer is provided particularly to improve the quality of color images. Specifically, a toner image held on the sheet P, which is to be fixed later, is formed by laminating powder toners of respective colors. For this reason, to apply heat evenly to the entire toner image at the nip portion N, the surface of the fixing belt 610 may desirably change shape according to the surface unevenness of the toner image on the sheet P.

The fixing roll 611 is a cylindrical roll formed of aluminum or SUS, for example, and rotates in a direction shown by an arrow in FIG. 2 by a rotational driving force of a drive motor (not shown). Then, the fixing roll 611 is heated to a predetermined temperature (e.g., 150° C.) by for example three halogen heaters 71 placed inside the fixing roll 611 as a heating source.

The inside heating roll 612 is a cylindrical roll formed of aluminum or SUS, for example. The inside heating roll 612 is heated to a predetermined temperature (e.g., 190° C.) by for example four halogen heaters 72 placed inside as a heating source.

Further, at both end portions, the inside heating roll 612 is provided with spring members (not shown) that press the fixing belt 610 from inside to outside, setting the overall tension of the fixing belt 610 to, for example, 15 kgf.

The inside heating roll 612 is further provided with a mechanism for controlling meandering (belt walk) of the fixing belt 610. Specifically, a belt edge position detecting mechanism (not shown) is provided near the inside heating roll 612 to detect the position of an edge of the fixing belt 610. The inside heating roll 612 is further provided with a displacement mechanism (not shown) for displacing one of edge portions of the inside heating roll 612 in a direction orthogonal to an axis direction of the inside heating roll 612. The displacement mechanism displaces the fixing belt 610 in the axis direction of the inside heating roll 612 by displacing one of the edge portions of the inside heating roll 612 according to a detection result of the belt edge position detecting mechanism. The belt walking of the fixing belt 610 is thus controlled.

The outside heating roll 613 is a cylindrical roll formed of aluminum or SUS, for example. The outside heating roll 613 is heated to a predetermined temperature (e.g., 190° C.) by for example three halogen heaters 73 placed inside as a heating source.

As described, the fixing unit 60 of the exemplary embodiment employs a configuration in which the fixing belt 610 is heated by the fixing roll 611, the inside heating roll 612, and the outside heating roll 613.

The peeling pad 64 is a block member having a substantially arc-shaped cross section and being formed of a rigid body such as a metal like SUS or a resin. Over the entire area of the fixing roll 611 in the axis direction, the peeling pad 64 is placed to be secured at a position downstream of and adjacent to an area where the pressure roll 62 is in pressure contact with the fixing roll 611 with the fixing belt 610 interposed therebetween (hereinafter, referred to as "roll nip portion N1"). The peeling pad 64 is installed to evenly press an area of a predetermined width (e.g., a 5 mm nip width in a traveling direction of the fixing belt 610) of the pressure roll 62 with the fixing belt 610 interposed therebetween with a predetermined load (e.g., 10 kgf average). The peeling pad 64 forms a "peeling pad nip portion N2" next to the roll nip portion N1.

The pressure roll 62 is a member that forms the nip portion N between itself and the fixing belt 610 by being pressed against the outer circumferential surface of the fixing belt 610. The nip portion N is where the sheet P holding an unfixed toner image passes. For example, the pressure roll 62 has a cylindrical roll formed of aluminum or SUS as a base on which an elastic layer formed of a silicon rubber and a release layer formed of a PFA tube are sequentially laminated in this order. The pressure roll 62 is placed to be contactable with and separable from the fixing belt module 61. When in contact (pressure contact) with the fixing belt module 61 while pressing thereagainst, the pressure roll 62 rotates in a direction shown by an arrow, driven by the fixing roll 611 of the fixing belt module 61 rotating in another direction shown by an arrow.

<Description of Fixing Operations of Fixing Unit>

Next, a description is given of fixing operations of the fixing unit 60 of the exemplary embodiment.

The sheet P on which a composite toner image (unfixed toner image) is electrostatically transferred at the secondary transfer area Tr (refer to FIG. 1) of the image forming apparatus 1 is transported toward the nip portion N (refer to FIG. 2) of the fixing unit 60 along the fourth transport path R4 (refer to FIG. 1). Then, the unfixed toner image held on the surface of the sheet P passing the nip portion N is fixed onto the sheet P by pressure and heat acting mainly on the roll nip portion N1.

Specifically, in the fixing unit 60 of the exemplary embodiment, heat acting on the roll nip portion N1 is supplied mainly by the fixing belt 610. The fixing belt 610 is heated by: heat supplied through the fixing roll 611 from the halogen heaters 71 placed inside the fixing roll 611; heat supplied through the inside heating 612 from the halogen heaters 72 placed inside the inside heating 612; and heat supplied through the outside heating roll 613 from the halogen heaters 73 placed inside the outside heating roll 613. Thus, heat energy is supplied from not only the fixing roll 611, but also the inside heating roll 612 and the outside heating roll 613. Consequently, a sufficient amount of heat may be obtained in the roll nip portion N1 even at a high process speed.

In the fixing unit 60 of the exemplary embodiment, the fixing belt 610 functioning as a direct-heating member may be configured with an extremely small heat capacity. In addition, the fixing belt 610 is configured to be in contact with each of the heat supplying members, the fixing roll 611, the inside heating roll 612, and the outside heating roll 613, with a large wrap area (a large wrap angle). Consequently, the sufficient amount of heat is supplied from the fixing roll 611, the inside heating roll 612, and the outside heating roll 613 in a short cycle in which the fixing belt 610 rotates one revolution. Accordingly, it takes only a short time for the fixing belt 610 to regain a temperature capable of fixing. Thereby, a predetermined fixing temperature is maintained at the roll nip portion N1.

As a result, even when sheets pass the fixing unit 60 of the exemplary embodiment successively at a high speed, the fixing unit 60 keeps its fixing temperature almost constant. Moreover, occurrence of a phenomenon in which the fixing temperature drops upon initiation of high-speed fixing operations (so-called "temperature droop phenomenon") is prevented. In particular, even in fixing to a thick sheet or the like requiring a large heat capacity, the fixing temperature is maintained and occurrence of the temperature droop phenomenon is prevented. Furthermore, because the fixing belt 610 has a small heat capacity, when the fixing temperature needs to be changed in the middle of the operations, depending on a sheet type (increasing and decreasing of the fixing temperature), the fixing temperature is easily changeable by adjusting outputs of the halogen heaters 71, the halogen heaters 72, and the halogen heaters 73.

Further, in the fixing unit 60 of the exemplary embodiment, the fixing roll 611 is a hard roll formed of aluminum, SUS, or the like, and the pressure roll 62 is a soft roll covered with an elastic layer. Accordingly, a nip area having a certain width in the traveling direction of the fixing belt 610 is formed in the roll nip portion N1, where the fixing roll 611 hardly deforms, while the surface of the pressure roll 62 deforms. As described, the side of the fixing roll 611 which is wrapped by the fixing belt 610 hardly changes shape in the roll nip portion N1. For this reason, the fixing belt 610 passes the roll nip portion N1 while keeping the moving speed almost constant. This prevents the fixing belt 610 from creasing or being deformed in the roll nip portion N1, so that a faxed image of good quality may be provided.

Subsequently, after passing the roll nip portion N1, the sheet P is transported to the peeling pad nip portion N2. In the peeling pad nip portion N2, the peeling pad 64 is pressed against the pressure roll 62, and the fixing belt 610 is in pressure contact with the pressure roll 62. Accordingly, the roll nip portion N1 has a shape curving downward due to the curvature of the fixing roll 611, whereas the peeling pad nip portion N2 has a shape curving upward due to the curvature of the pressure roll 62.

Accordingly, the sheet P heated and pressed under the curvature of the fixing roll 611 in the roll nip portion N1 changes its traveling direction in the peeling pad nip portion N2 according to the curvature of the pressure roll 62 which is curved in an opposite direction. In this direction change, an extremely little slippage occurs between the toner image on the sheet P and the surface of the fixing belt 610. Thereby, adhesion between the toner image and the fixing belt 610 weakens, facilitating the sheet P to be peeled off from the fixing belt 610. Hence, the peeling pad nip portion N2 may be regarded as a preparation step for secure peeling in a final peeling step.

Then, since the fixing belt 610 is transported so as to wind around the peeling pad 64 in an exit of the peeling pad nip portion N2, the transport direction of the fixing belt 610 drastically changes at this exit. To be more specific, since the fixing belt 610 moves along the outer surface of the peeling pad 64, the fixing belt 610 is caused to form a large curve. For this reason, the sheet P whose adhesion to the fixing belt 610 is weakened in the peeling pad nip portion N2 is separated from the fixing belt 610 by the stiffness of the sheet P itself.

Then, the traveling direction of the sheet P separated from the fixing belt 610 is led by a peeling guide plate 69 serving as an example of a peeling guide member placed downstream of the peeling pad nip portion N2. The sheet P guided by the peeling guide plate 69 is thereafter transported toward the cooling unit 80 by an exit guide 78 serving as an example of an exit guide member and by an exit belt 79. More specifically, the peeling guide plate 69 is a member that separates the sheet P peeled off from the fixing belt 610 from the fixing belt 610 completely, and that sets a traveling direction of the sheet P. The exit guide 78 and the exit belt 79 are members that smoothly guide, toward the cooling unit 80, the sheet P for which the traveling direction is set by the peeling guide plate 69.

With the operations described above, the fixing process of the fixing unit 60 is completed.

<Description of Cooling Mechanism of Pressure Roll>

As described above, heat and pressure are applied to the sheet P in the nip portion N, thus fixing the unfixed toner image. Here, if cracks are caused on the surface of the pressure roll 62 by some factors, in some cases, there occurs a defect in the fixed image because the cracks are transferred onto the sheet P. This particularly tends to be caused in duplex printing. Specifically, in the duplex printing, as described with reference to FIG. 1, the sheet P having a fixed image formed on a first surface thereof is transported along the sixth transport path R6, the seventh transport path R7 and the third transport path R3, and then the color toner images for the second surface are collectively subjected to the secondary transfer onto the sheet P. After the secondary transfer, via the fourth transport path R4, the sheet P enters the fixing unit 60 again for fixing the toner image on the second surface thereof. At this time, the fixed image on the first surface exists on the pressure roll 62 side, and in some cases, a part of toner forming the fixed image on the first surface is melted again by heat supplied in the nip portion N. Pressure is also applied together with heat, and as a result, the cracks caused on the pressure roll 62 are transferred to the first surface and the defect occurs in the fixed image, thus deteriorating the quality of the image.

The cracks on the pressure roll 62 are likely to occur in the case where the surface temperature of the pressure roll 62 rises excessively. Specifically, the surface of the pressure roll 62 is a release layer formed with the PFA tube as described above, and is an elastic body. As the temperature is higher, the surface hardness is lowered, namely, softened. Therefore, as the surface temperature of the pressure roll 62 is higher, the cracks on the surface are more likely to occur.

Consequently, in the exemplary embodiment, a cooling unit 120 is provided. In the case where the surface temperature of the pressure roll 62 is higher than a predetermined temperature, the surface temperature of the pressure roll 62 is lowered by the cooling unit 120 to suppress the occurrence of cracks on the surface.

Specifically, as shown in FIG. 2, the fixing unit 60 of the exemplary embodiment includes the cooling unit 120 that cools the surface of the pressure roll 62 and a temperature sensor 130, as an example of a temperature detector, which detects the surface temperature of the pressure roll 62. The fixing unit 60 also includes an air blower controller 140 that controls the cooling unit 120 based on the temperature detected by the temperature sensor 130.

Figure 3:
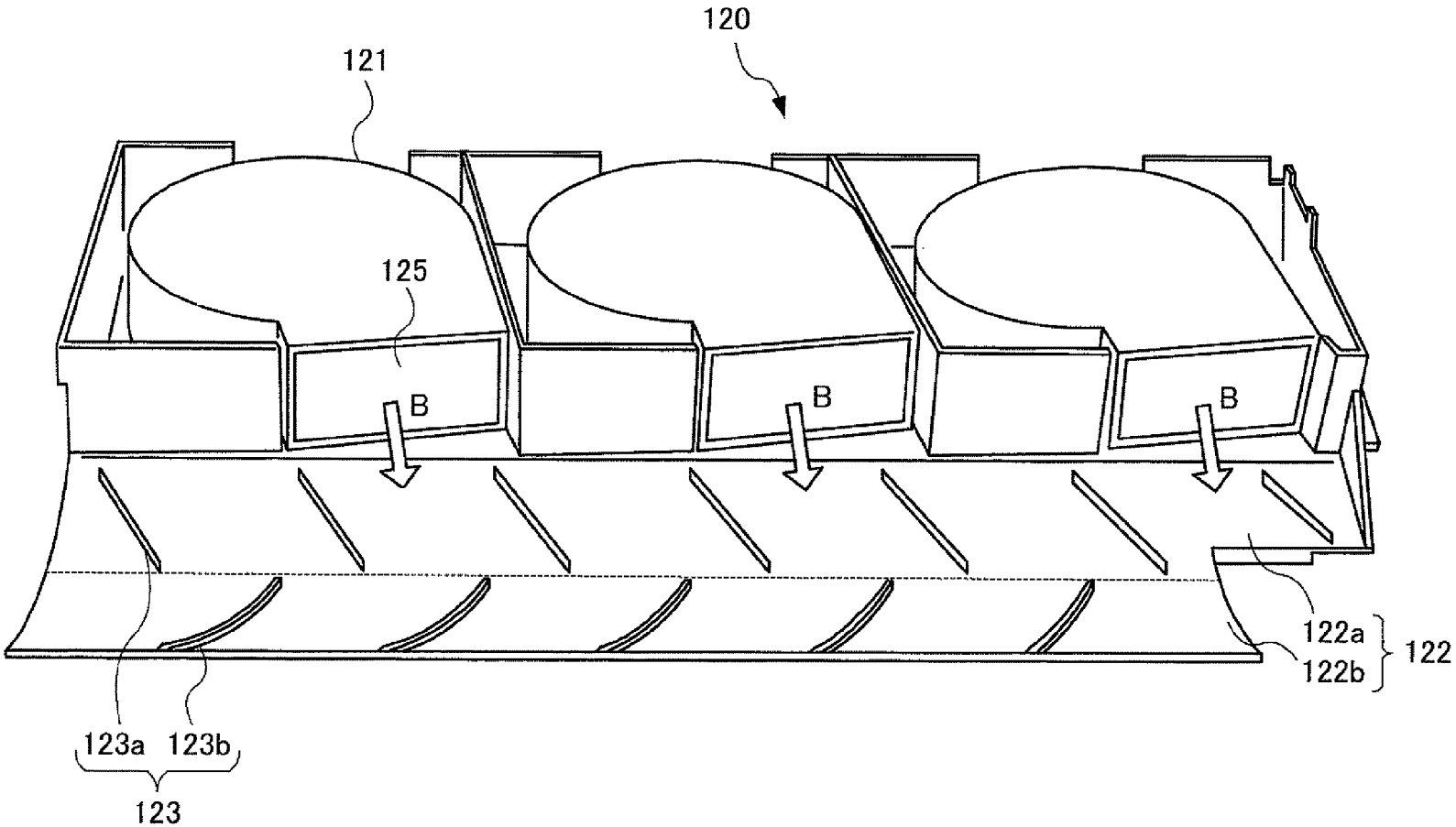
FIG. 3 illustrates a cooling unit further in detail, as viewed from an exit direction of a sheet.

FIG. 3 illustrates the cooling unit 120 further in detail, as viewed from an exit direction of the sheet P. Hereinafter, the cooling unit 120 will be described with reference to FIGS. 2 and 3.

As shown in FIGS. 2 and 3, the cooling unit 120 includes a fan 121 as an example of an air blower that generates an air flow, a pan 122 as an example of a circulator that circulates the air flow around the pressure roll 62 and ribs 123, as an example of a group of protruding portions, which are arranged on the pan 122 to guide the air flow, namely, to define a direction of the air flow. The cooling unit 120 also includes a branch portion 124 that causes the air flow to branch.

The fan 121 is not limited to any particular type as long as the air flow can be generated. In the exemplary embodiment, for example, a sirocco fan or a turbo fan may be used. The air flow generated by the fan 121 flows from an air outlet port 125 toward the pan 122. In the exemplary embodiment, the air flow is generated by three fans 121. The speed of the air flow at the air outlet port 125 may be, for example, about 5 m/s.

The pan 122 may be manufactured by molding, for example, resin or the like. In the exemplary embodiment, the pan 122 is configured with a flat plane portion 122*a* and a curved plane portion 122*b*. Provided with the flat plane portion 122*a* and the curved plane portion 122*b*, the pan 122 may be arranged along the pressure roll 62 in the proximity thereof. Accordingly, the cross-sectional area of the air flow passing between the pan 122 and the pressure roll 62 is smaller than the cross-sectional area of the air outlet port 125. This makes the speed of the air flow at the location between the pan 122 and the pressure roll 62 higher than that at the location of the air outlet port 125. Specifically, the speed of the air flow between the pan 122 and the pressure roll 62 may be about 9 m/s, for example. By making the speed of the air flow higher, cooling efficiency of the pressure roll 62 may be improved.

The ribs 123 arranged on the pan 122 to face the pressure roll 62 may be integrally molded with the pan 122 when the pan 122 is molded. In the exemplary embodiment, the ribs 123 are arranged in directions different from a direction in parallel to the direction of circulation of the air flow. Consequently, the air flow comes into collision with the ribs 123, and a part of the air flow circulates toward the pressure roll 62. Thus the air flow circulates between the pan 122 and the pressure roll 62 is guided. In this case, as the air flow between the pan 122 and the pressure roll 62 is guided, the speed of the air flow in the proximity of the pressure roll 62 is also likely to increase. As a result, the cooling efficiency of the pressure roll 62 may be improved.

Further, in the exemplary embodiment, as shown in FIG. 3, the ribs 123 includes ribs 123*a*, as first protruding portions, which are arranged in parallel with each other in an upstream side of the air flow and ribs 123*b*, as second protruding portions, which are arranged in parallel with each other in a direction different from that of the ribs 123*a*. The ribs 123*a* are arranged on the flat plane portion 122*a* of the pan 122, and the ribs 123*b* are arranged on the curved plane portion 122*b* of the pan 122. It should be noted that, a dotted line indicates a boundary between the flat plane portion 122*a* and the curved plane portion 122*b* in FIG. 3. In this manner, ribs are provided in different directions, thus the air flow is guided as described above with higher efficiency. As a result, the cooling efficiency of the pressure roll 62 may be further improved.

The branch portion 124 divides the air flow generated by the fans 121 into branches of an air flow circulating along a rotational direction of the pressure roll 62 and an air flow circulating against the rotational direction of the pressure roll 62. The air flow circulating between the pan 122 and the pressure roll 62 as described above is an air flow B that circulates against the rotational direction of the pressure roll 62. The air flow circulating along the rotational direction of the pressure roll 62 is an air flow A that substantially upwardly circulates in FIG. 2. In this manner, by branching off the air flow into two directions, the cooling efficiency of the pressure roll 62 is further improved. Specifically, the surface of the pressure roll 62 and the air flow are brought into contact with each other at a larger area, and thereby more heat may be transmitted from the surface of the pressure roll 62 to the air flow. In the exemplary embodiment, the speed of the air flow B is substantially the same as the speed of the air flow at the air outlet port 125, which is, for example, about 5 m/s. Accordingly, if the air flow is circulated more in the air flow B than in the air flow A, the cooling efficiency of the pressure roll 62 may be easily improved. In the exemplary embodiment, 25% of the air flow generated by the fans 121 may be circulated to the air flow A, while 75% of the air flow generated by the fans 121 may be circulated to the air flow B, for example.

It should be noted that, in the exemplary embodiment, the branch portion 124 may be formed by a gap provided between the pan 122 and the pressure roll 62. Therefore, the branch portion 124 may be captured as a gap portion or an opening portion. In this exemplary embodiment, a pan, which is provided for the air flow B, is not provided for the air flow A after passing through the branch portion 124, however, the pan may also be provided for the air flow A. If provided, ribs may be formed on the pan in the same manner as the pan for the air flow B.

It should be noted that a pattern of the ribs 123 formed on the pan 122 is not limited to the case as shown in FIG. 3 and described above.

FIGS. 4A to 4F are conceptual diagrams illustrating various forms of the patterns of the ribs 123 formed on the pan 122.

Figure 4A:
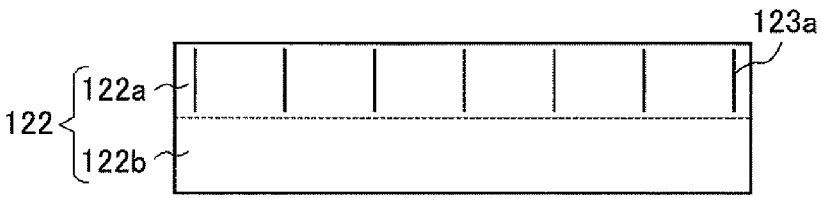
FIGS. 4A to 4F are conceptual diagrams for illustrating various forms of patterns of ribs formed on a pan.
Figure 4B:
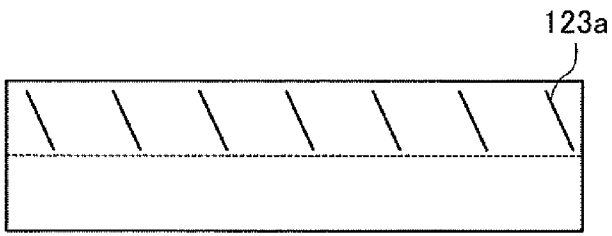
Figure 4C:
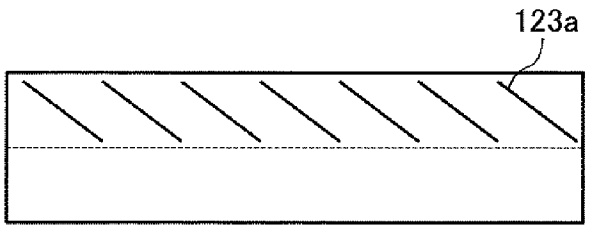

The patterns shown in FIGS. 4A to 4C are examples of providing only ribs 123*a* arranged on the upstream side of the air flow without providing ribs 123*b* arranged on the downstream side of the air flow.

Among them, in the pattern shown in FIG. 4A, the ribs 123*a* are arranged substantially in parallel with the air flow. Meanwhile, in the patterns shown in FIGS. 4B and 4C, the ribs 123*a* are arranged in directions not in parallel with the air flow. In the pattern shown in FIG. 4C, the ribs 123*a* form a larger angle with respect to the air flow compared to the ribs 123*a* in the pattern shown in FIG. 4B.

Figure 4D:
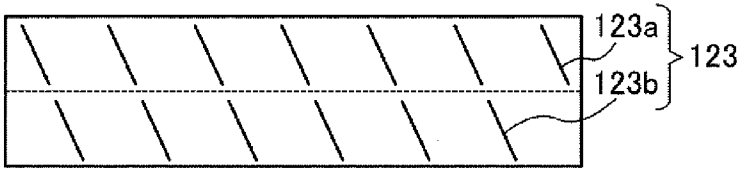
Figure 4E:
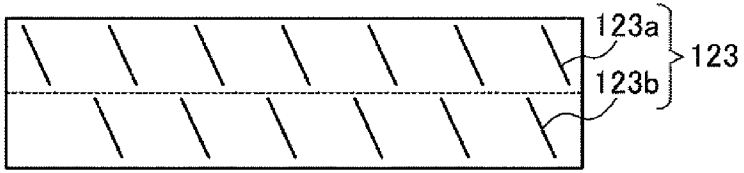
Figure 4F:
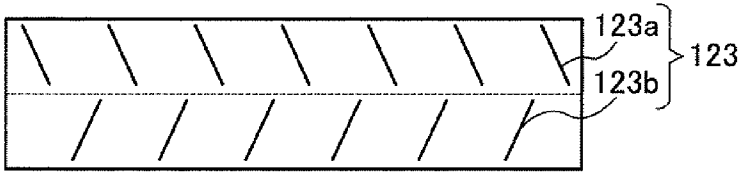

On the other hand, FIGS. 4D to 4F show the patterns in which both the ribs 123*a* arranged on the upstream side of the air flow and the ribs 123*b* arranged on the downstream side of the air flow are provided.

Among them, the pattern shown in FIG. 4F is the pattern as described above with reference to FIG. 3. In this pattern, as described above, the ribs are arranged not in parallel with the direction of circulation of the air flow. The ribs 123 includes the ribs 123*a* which are arranged in parallel with each other on the upstream side of the air flow and the ribs 123*b* which are arranged in parallel with each other in a direction different from that of the ribs 123*a*.

The patterns shown in FIGS. 4D and 4E are, in comparison with the pattern shown in FIG. 4F, similar in the way that the ribs 123 are provided not in parallel with the direction of circulation of the air flow. However, the ribs 123 includes the ribs 123*a* which are arranged in parallel with each other on the upstream side of the air flow and the ribs 123*b* which are arranged in parallel with each other on the downstream side of the air flow substantially in the same direction as that of the ribs 123*a*. Among these patterns, in the pattern shown in FIG. 4D, the ribs 123*b* are arranged on an extension of the ribs

123*a*. Meanwhile, in the pattern shown in FIG. 4E, the ribs 123*a* and the ribs 123*b* are arranged alternately.

In comparison with the patterns shown in FIGS. 4A to 4C, the patterns shown in FIGS. 4D to 4F enable the ribs to guide the air flow with higher efficiency. That is, increased efficiency is available in guiding the air flow by not only providing the ribs 123*a* arranged on the upstream side of the air flow, but also providing the ribs 123*b* arranged on the downstream side of the air flow.

Among the patterns shown in FIGS. 4D to 4F, the pattern shown in FIG. 4F may provide the most efficient air flow guiding. That is, the ribs 123*a* and the ribs 123*b* may be arranged in different directions from each other with respect to the direction of circulation of the air flow.

Moreover, among the patterns shown in FIGS. 4A to 4C, the pattern shown in FIG. 4B may provide the most efficient air flow guiding. Specifically, though the ribs 123*a* may be arranged not in parallel with the direction of circulation of the air flow, the efficiency in guiding the air flow is reduced in the case where the ribs 123*a* form an excessively large angle with respect to the direction of circulation of the air flow. That is, in this case, the ribs 123*a* inhibit the circulation of the air flow, and the efficiency in guiding the air flow is thus considered to be reduced.

In addition, other patterns may be considered, which only provide the ribs 123*b* arranged on the downstream side of the air flow without providing the ribs 123*a* arranged on the upstream side of the air flow, as opposed to the patterns shown in FIGS. 4A to 4C. The efficiency in guiding the air flow may be improved by these patterns. However, the ribs arranged on the upstream side of the air flow as the patterns shown in FIGS. 4A to 4C may enable more efficient air flow guiding. This is because the ribs arranged on the upstream side of the air flow suppress air flow turbulence that is likely to occur on the downstream side of the ribs, thus making it possible to guide more air flow.

The temperature sensor 130 is not limited to any particular type as long as the surface temperature of the pressure roll 62, which is an object of measurement, can be measured. For example, a temperature sensor of a thermistor type may be used.

The air blower controller 140 obtains surface temperature information of the pressure roll 62 from the temperature sensor 130. When the surface temperature of the pressure roll 62 becomes not less than a predetermined temperature, the air blower controller 140 exerts control of the cooling unit 120 to operate. Consequently, the surface temperature of the pressure roll 62 is decreased. Further, if the surface temperature of the pressure roll 62 is lowered to less than a predetermined temperature by the cooling unit 120, the air blower controller 140 exerts control to stop the operation of the cooling unit 120.

By performing control as described above, the surface temperature of the pressure roll 62 is maintained to fall within a certain range, and thereby occurrence of the cracks on the surface of the pressure roll 62 is suppressed.

It should be noted that, in the exemplary embodiment, the air blower controller 140 is provided inside the fixing unit 60 (refer to FIG. 2) in the above-described example. However, the air blower controller 140 may be provided outside of the fixing unit 60 but inside the image forming apparatus 1 (refer to FIG. 1). In such a case, the air blower controller 140 may be provided as a part of the main controller 50 (refer to FIG. 1).

It should also be noted that the image forming apparatus 1 of the electrophotographic system is taken as an example in the exemplary embodiment. However, the image forming apparatus 1 may employ an ink jet system.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a heating member that heats a recording medium;

a pressure member that forms a heating pressure portion between the pressure member and the heating member by coming into pressure contact with an outer circumferential surface of the heating member, the heating pressure portion being passed through by the recording medium;

a tensioning member that is placed to face the pressure member with the heating member interposed therebetween, and that provides a tension to the heating member; and a cooling unit that cools the pressure member, the cooling unit including:

an air blower that generates an air flow;

a circulator that circulates the air flow along the pressure member; and a group of protruding portions that is provided on the circulator to guide the air flow, wherein protruding portions of the group of protruding portions are arranged in a direction not in parallel with a direction of circulation of the air flow.

2. The heating device according to claim 1, wherein the group of protruding portions includes a plurality of first protruding portions provided on an upstream side of the air flow, in which the first protruding portions are arranged in parallel with each other, and a plurality of second protruding portions provided on a downstream side of the air flow, in which the second protruding portions are arranged in parallel with each other in a direction different from that of the plurality of first protruding portions.

3. The heating device according to claim 2, wherein the circulator of the cooling unit comprises a branch portion that divides the air flow into branches of an air flow circulating along a rotational direction of the pressure member and an air flow circulating against the rotational direction of the pressure member.

4. The heating device according to claim 3, further comprising:

a temperature detector that detects a temperature of the pressure member; and an air blower controller that controls the air blower based on a temperature detected by the temperature detector.

5. The heating device according to claim 2, further comprising:

a temperature detector that detects a temperature of the pressure member; and an air blower controller that controls the air blower based on a temperature detected by the temperature detector.

6. The heating device according to claim 1, wherein the circulator of the cooling unit comprises a branch portion that divides the air flow into branches of an air flow circulating along a rotational direction of the pressure member and an air flow circulating against the rotational direction of the pressure member.

7. The heating device according to claim 6, further comprising:

a temperature detector that detects a temperature of the pressure member; and an air blower controller that controls the air blower based on a temperature detected by the temperature detector.

8. The heating device according to claim 1, further comprising:

a temperature detector that detects a temperature of the pressure member; and an air blower controller that controls the air blower based on a temperature detected by the temperature detector.

9. The heating device according to claim 1, further comprising a peeling member that is placed in a region downstream of the heating pressure portion, in a direction in which the recording medium proceeds, at a position adjacent to the tensioning member, and that peels off the recording medium from the heating member.

10. The heating device according to claim 1, wherein the protruding portions are arranged on an upstream side of the airflow.

11. The heating device according to claim 1, wherein the protruding portions are arranged on upstream and downstream sides of the airflow.

12. The heating device according to claim 1, wherein the protruding portions includes a first protruding portion on an upstream side of the airflow and a second protruding portion on the upstream side of the airflow, the first and second protruding portions arranged in parallel with each other.

13. The heating device according to claim 1, wherein the protruding portions includes a first protruding portion on an upstream side of the airflow and a second protruding portion on a downstream side of the airflow, the first and second protruding portions arranged in parallel with each other.

14. The heating device according to claim 13, wherein the second protruding member is an extension of the first protruding member.

15. The heating device according to claim 13, wherein the first and second protruding portions are arranged alternatively.

16. The heating device according to claim 1, wherein the protruding portions includes a first protruding portion on an upstream side of the airflow and a second protruding portion on the upstream side of the airflow, the first protruding portion arranged in a direction different from that of the second protruding portion.

17. A heating device comprising:

a heating member that heats a recording medium;

a pressure member that forms a heating pressure portion between the pressure member and the heating member by coming into pressure contact with an outer circumferential surface of the heating member, the heating pressure portion being passed through by the recording medium;

a tensioning member that is placed to face the pressure member with the heating member interposed therebetween, and that provides a tension to the heating member; and a cooling unit that cools the pressure member, the cooling unit including:

an air blower that generates an air flow;

a circulator that circulates the air flow along the pressure member; and a group of protruding portions that is provided on the circulator to guide the air flow, wherein the circulator of the cooling unit comprises a branch portion that divides the air flow into branches of an air flow circulating along a rotational direction of the pressure member and an air flow circulating against the rotational direction of the pressure member.

18. The heating device according to claim 17, further comprising:

a temperature detector that detects a temperature of the pressure member; and an air blower controller that controls the air blower based on a temperature detected by the temperature detector.

19. A heating device comprising:

a heating member that heats a recording medium;

a pressure member that forms a heating pressure portion between the pressure member and the heating member by coming into pressure contact with an outer circumferential surface of the heating member, the heating pressure portion being passed through by the recording medium;

a tensioning member that is placed to face the pressure member with the heating member interposed therebetween, and that provides a tension to the heating member;

a cooling unit that cools the pressure member, the cooling unit including:

an air blower that generates an air flow;

a circulator that circulates the air flow along the pressure member; and a group of protruding portions that is provided on the circulator to guide the air flow;

a temperature detector that detects a temperature of the pressure member; and an air blower controller that controls the air blower based on a temperature detected by the temperature detector.

20. An image forming apparatus comprising:

an image forming unit that forms an image;

a transfer unit that transfers the image formed by the image forming unit onto a recording medium; and a heating unit including:

a heating member that heats the recording medium;

a pressure member that forms a heating pressure portion between the pressure member and the heating member by coming into pressure contact with an outer circumferential surface of the heating member, the heating pressure portion being passed through by the recording medium;

a tensioning member that is placed to face the pressure member with the heating member interposed therebetween, and that provides a tension to the heating member;

a peeling member that is placed in a region downstream of the heating pressure portion, in a direction in which the recording medium proceeds, at a position adjacent to the tensioning member, and that peels off the recording medium from the heating member; and a cooling unit that cools the pressure member, the cooling unit including:

an air blower that generates an air flow;

a circulator that circulates the air flow along the pressure member; and a group of protruding portions that is provided on the circulator and guides the air flow, wherein protruding portions of the group of protruding portions are arranged in a direction not in parallel with a direction of circulation of the air flow.

21. An image forming apparatus comprising:

an image forming unit that forms an image;

a transfer unit that transfers the image formed by the image forming unit onto a recording medium; and a heating unit including:

a heating member that heats the recording medium;

a pressure member that forms a heating pressure portion between the pressure member and the heating member by coming into pressure contact with an outer circumferential surface of the heating member, the heating pressure portion being passed through by the recording medium;

a tensioning member that is placed to face the pressure member with the heating member interposed therebetween, and that provides a tension to the heating member;

a peeling member that is placed in a region downstream of the heating pressure portion, in a direction in which the recording medium proceeds, at a position adjacent to the tensioning member, and that peels off the recording medium from the heating member; and a cooling unit that cools the pressure member, the cooling unit including:

an air blower that generates an air flow;

a circulator that circulates the air flow along the pressure member; and a group of protruding portions that is provided on the circulator and guides the air flow;

a temperature detector that detects a temperature of the pressure member; and an air blower controller that controls the air blower based on a temperature detected by the temperature detector.

22. An image forming apparatus comprising:

an image forming unit that forms an image;

a transfer unit that transfers the image formed by the image forming unit onto a recording medium; and a heating unit including:

a heating member that heats the recording medium;

a pressure member that forms a heating pressure portion between the pressure member and the heating member by coming into pressure contact with an outer circumferential surface of the heating member, the heating pressure portion being passed through by the recording medium;

a tensioning member that is placed to face the pressure member with the heating member interposed therebetween, and that provides a tension to the heating member;

a peeling member that is placed in a region downstream of the heating pressure portion, in a direction in which the recording medium proceeds, at a position adjacent to the tensioning member, and that peels off the recording medium from the heating member; and a cooling unit that cools the pressure member, the cooling unit including:

an air blower that generates an air flow;

a circulator that circulates the air flow along the pressure member; and a group of protruding portions that is provided on the circulator and guides the air flow, wherein the circulator of the cooling unit comprises a branch portion that divides the air flow into branches of an air flow circulating along a rotational direction of the pressure member and an air flow circulating against the rotational direction of the pressure member.

* * * * *